US006811220B2

(12) United States Patent
Shea et al.

(10) Patent No.: US 6,811,220 B2
(45) Date of Patent: Nov. 2, 2004

(54) APPARATUS FOR AUTOMATICALLY RAISING AND LOWERING A SEAT

(75) Inventors: Joseph Shea, Factoryville, PA (US); Thomas Telesz, Old Forge, PA (US)

(73) Assignee: North American Manufacturing Company, Inc., Scranton, PA (US)

( * ) Notice: Subject to any disclaimer, the term of this patent is extended or adjusted under 35 U.S.C. 154(b) by 16 days.

(21) Appl. No.: 10/262,186

(22) Filed: Oct. 1, 2002

(65) Prior Publication Data

US 2003/0062751 A1 Apr. 3, 2003

Related U.S. Application Data

(60) Provisional application No. 60/326,437, filed on Oct. 2, 2001.

(51) Int. Cl.[7] ..... A47K 13/10

(52) U.S. Cl. ..... 297/313; 297/330; 297/DIG. 10; 4/667; 4/254

(58) Field of Search ..... 297/DIG. 10, 330, 297/313; 4/667, 254

(56) References Cited

U.S. PATENT DOCUMENTS

| | | | | |
|---|---|---|---|---|
| 3,458,872 A | * | 8/1969 | Hellstrom et al. | 297/DIG. 10 X |
| 3,473,174 A | | 10/1969 | Cool | |
| 3,479,086 A | * | 11/1969 | Sheridan | 297/DIG. 10 X |
| 4,031,576 A | * | 6/1977 | Epstein | 297/DIG. 10 X |
| 4,185,335 A | * | 1/1980 | Alvis | 297/DIG. 10 X |
| 4,581,778 A | | 4/1986 | Pontoppidan | 297/DIG. 10 X |
| 4,690,457 A | * | 9/1987 | Poncy et al. | 297/DIG. 10 X |
| 4,752,100 A | * | 6/1988 | Lemaire | 297/DIG. 10 X |
| 4,884,841 A | * | 12/1989 | Holley | 297/DIG. 10 X |
| 4,938,533 A | * | 7/1990 | Thielois | 297/DIG. 10 X |
| 4,979,726 A | * | 12/1990 | Geraci | 297/DIG. 10 X |
| 5,063,617 A | * | 11/1991 | Ward et al. | 297/DIG. 10 X |
| 5,137,102 A | * | 8/1992 | Houston, Sr. et al. | 297/DIG. 10 X |
| 5,142,709 A | | 9/1992 | McGuire | 4/669 |
| 5,155,873 A | | 10/1992 | Bridges | 297/330 X |
| 5,309,583 A | | 5/1994 | White et al. | 297/DIG. 10 X |
| 5,312,157 A | * | 5/1994 | Logan, Jr. | 297/DIG. 10 X |
| 5,440,767 A | | 8/1995 | Bergenwall | 4/667 |
| 5,561,872 A | | 10/1996 | Phillips | 4/667 |
| 5,588,162 A | * | 12/1996 | Robinson | 297/DIG. 10 X |
| 5,592,703 A | | 1/1997 | Jones et al. | 297/DIG. 10 X |
| 5,661,858 A | | 9/1997 | House et al. | 297/DIG. 10 X |
| 6,113,188 A | | 9/2000 | Stewart et al. | 297/DIG. 10 X |
| 6,142,568 A | * | 11/2000 | Abelbeck et al. | 297/DIG. 10 X |
| 6,154,896 A | * | 12/2000 | Houston et al. | 297/DIG. 10 X |
| 6,161,229 A | * | 12/2000 | Ryan et al. | 297/DIG. 10 X |
| 6,189,164 B1 | * | 2/2001 | Krapu | 297/DIG. 10 X |
| 6,213,554 B1 | * | 4/2001 | Marcoux et al. | 297/DIG. 10 X |
| 6,385,797 B1 | * | 5/2002 | Phillips | 297/DIG. 10 X |
| 6,438,769 B1 | * | 8/2002 | Luckenbill | 297/DIG. 10 X |
| 6,507,961 B1 | * | 1/2003 | Ning-hwa | 297/DIG. 10 X |
| 6,540,250 B1 | * | 4/2003 | Peterson | 297/DIG. 10 X |
| 6,622,320 B2 | * | 9/2003 | Ward | 297/DIG. 10 X |

* cited by examiner

*Primary Examiner*—Rodney B. White
(74) *Attorney, Agent, or Firm*—RatnerPrestia

(57) ABSTRACT

An apparatus to automatically raise and lower a planar member, particularly a seat, that includes a number of pivotally connected support members, all attached directly or indirectly to a base member, one of the support members being mechanically actuable, vertically extending, and vertically extendable. The seat or planar member has a range of motion that is restricted to the middle portion of the base member, the base member having a portion extending forwardly therefrom.

12 Claims, 5 Drawing Sheets

APPARATUS FOR AUTOMATICALLY RAISING AND LOWERING A SEAT

CROSS REFERENCE TO RELATED APPLICATION

This application claims the benefit of priority to U.S. Provisional Patent Application Ser. No. 60/326,437, filed on Oct. 2, 2001.

FIELD OF THE INVENTION

This invention relates to an apparatus for raising and lowering a planar member, particularly a seat for moving a person from (and to) a seated position to (and from) a standing position. In one embodiment, it relates to an improved commode seat apparatus for lowering or raising a person in relation to a commode.

BACKGROUND OF THE INVENTION

There has been a long existing need to provide handicapped persons as well as the weak and infirm, such as post-operative patients in hospital care, with toilet facilities which are suitable for their use without assistance or with minimal assistance from hospital or home nursing personnel. Apart from obvious advantages of such a commode, including reducing the demands on the time of often overworked nursing personnel, the personal dignity that comes with self-sufficiency in areas of personal hygiene is immeasurable.

SUMMARY OF THE INVENTION

This invention provides an apparatus to raise and lower a planar member, such as a seat, in relation to, for example, a commode positioned below the seat. The apparatus is configured with a base which extends forwardly from the front of the apparatus to support a user's standing weight, and the apparatus is attached to the commode. In one embodiment, a U-shaped brace is positioned over the commode and attached to the base. In one embodiment, a hydraulic cylinder, including an extendable and retractable rod, powers the movement of the seat relative to the base by actuating a vertically extendable and retractable, vertically disposed support member, acting in conjunction with additional, pivotally connected support members located rearward of the vertically disposed support member. When the vertically extendable member is extended, the seat pivots upwardly about a forward point on the seat which moves upwardly coincident with the first support member, as the seat is raised. Retracting the vertically extended member produces a reverse movement.

BRIEF DESCRIPTION OF THE DRAWINGS

The invention will be described with reference to the exemplary embodiments illustrated in the figures of which.

DETAILED DESCRIPTION OF THE INVENTION

The invention will now be described with reference to the figures, which illustrate a particular embodiment thereof. It will be appreciated that the spirit and scope of the invention is not limited to the embodiment selected for illustration. Also, it should be noted that the drawings are not rendered to any particular scale or proportion. It is contemplated that any of the configurations and materials described hereafter can be modified within the scope of this invention.

Figure 1:
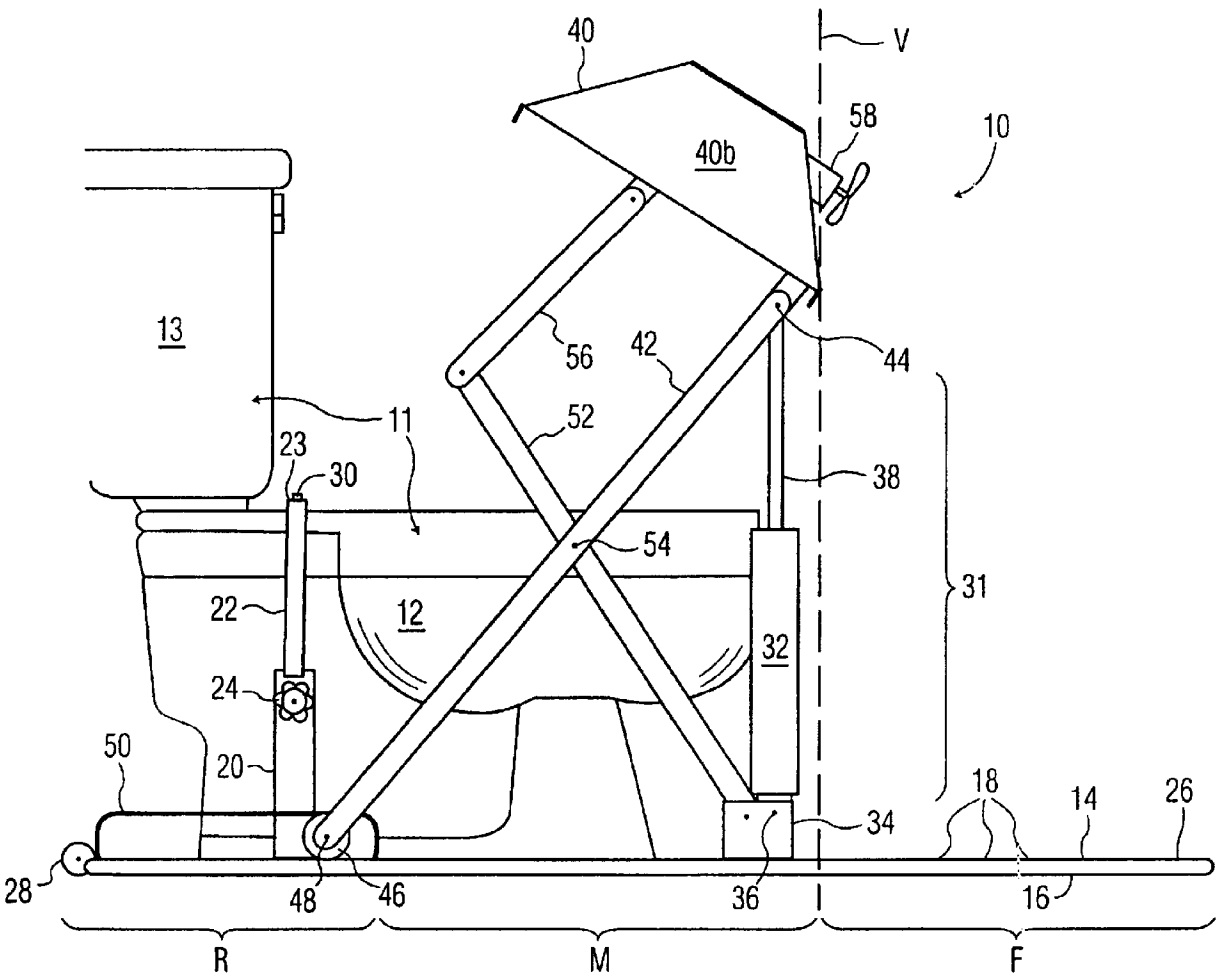
FIG. 1 is a side plan view of an embodiment of an apparatus according the present invention.
Figure 2:
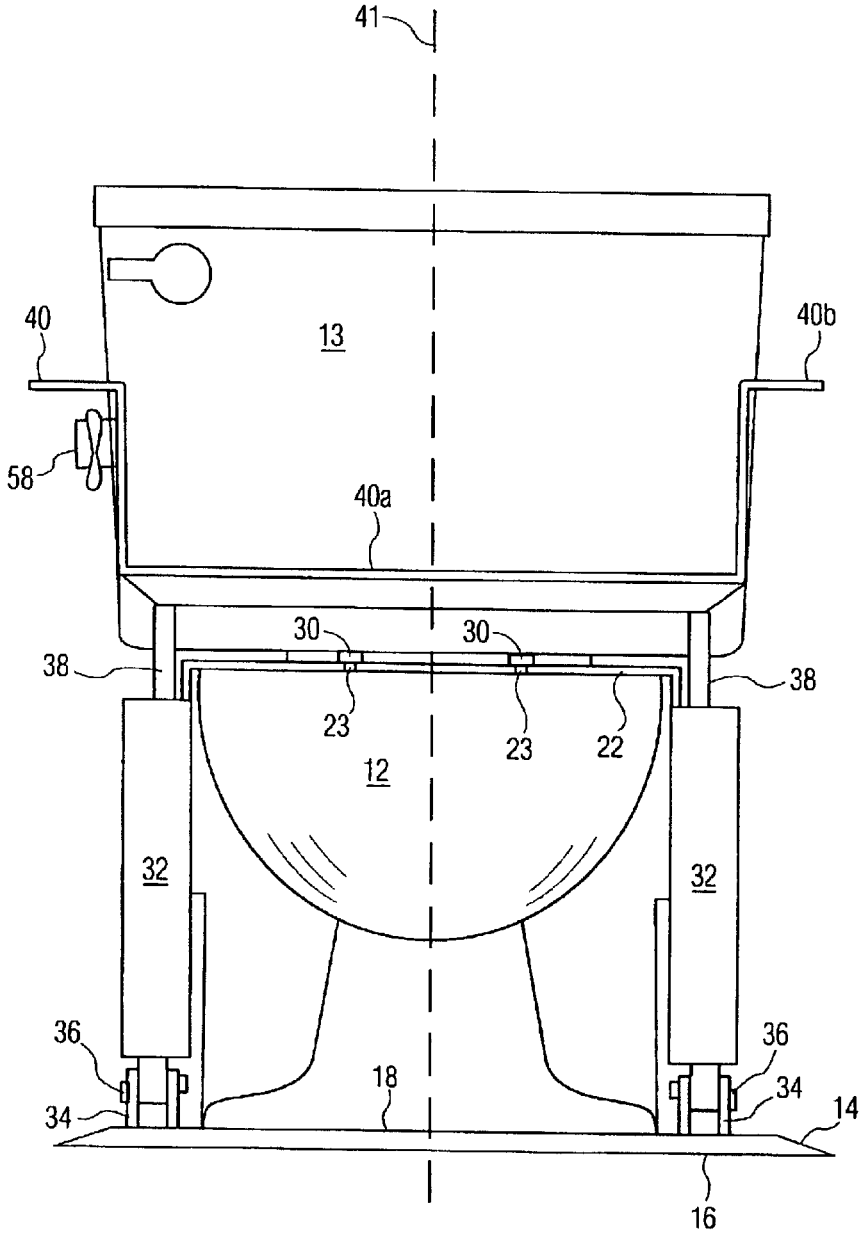
FIG. 2 is a front plan view of the apparatus illustrated in FIG. 1.
Figure 3:
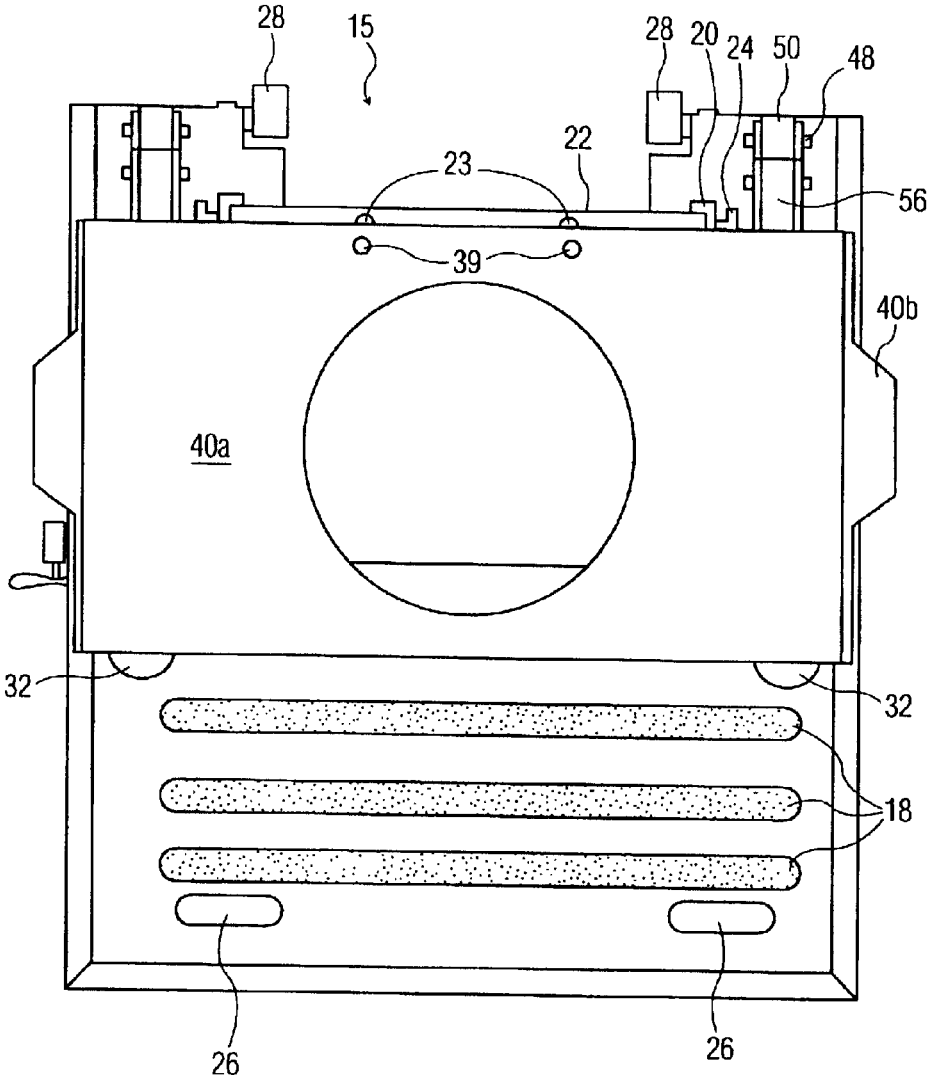
FIG. 3 is a top plan view of the apparatus illustrated in FIG. 1.
Figure 4:
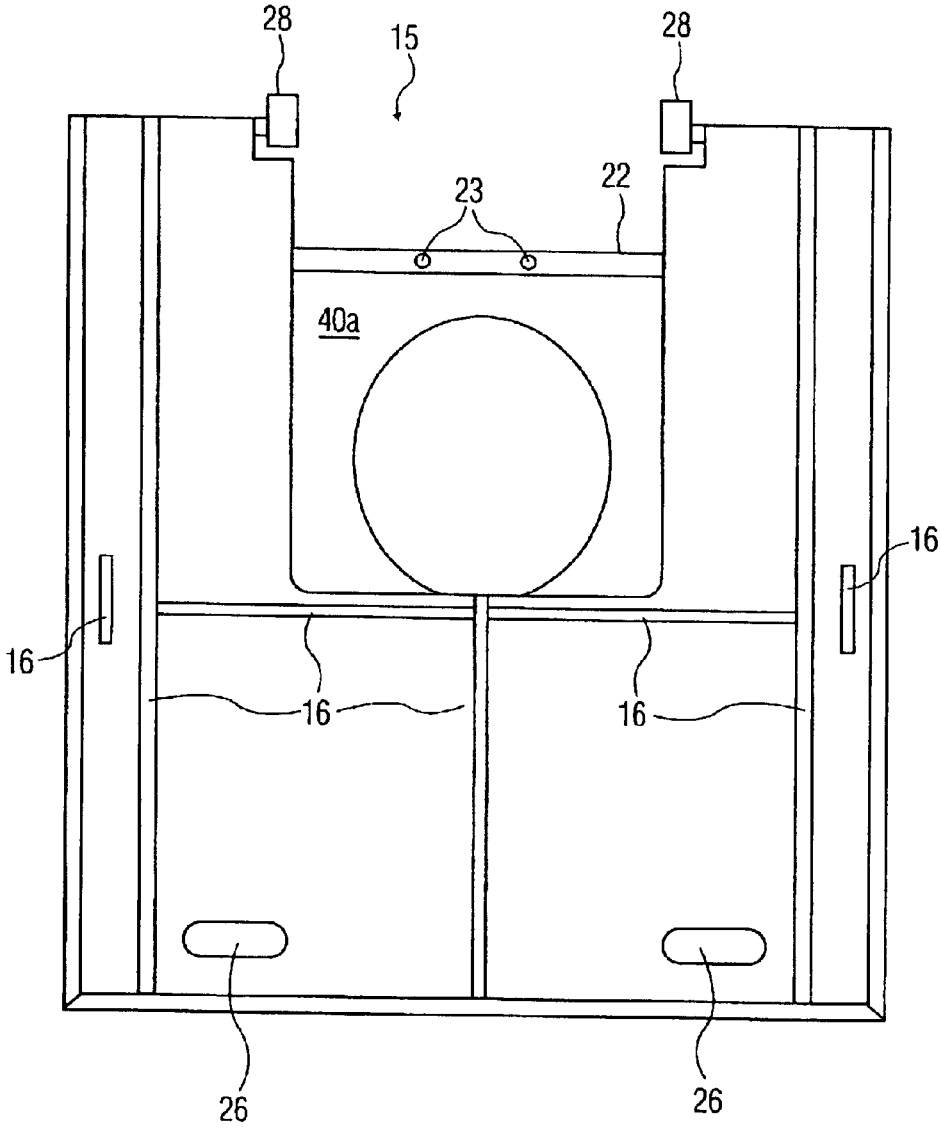
FIG. 4 is a bottom plan view of the apparatus illustrated in FIG. 1.

Referring to FIGS. 1 through 5, a commode assembly 11 is shown adjacent a preferred embodiment of a lifting and lowering apparatus 10 according to the present invention. In this embodiment, lifting and lowering apparatus 10, according to the present invention, is used with commode assembly 11, which includes a toilet tank 13 and a pot 12, typically constructed of porcelain or the like. Apparatus 10 includes a base member 14, typically formed from a sheet and/or lengths of metal or other rigid material, attached (e.g., by mechanical joint or weld) to tubing supports 16 located on opposite sides of pot 12. Base 14 includes a forward portion F, a middle portion M, and a rearward portion R. Base 14 further includes an opening 15 for accommodating commode 11 when apparatus 10 is in place adjacent commode 11 (see FIG. 3). Tubing supports 16 are connected by welding to the bottom surface of base 14, as illustrated in FIG. 4, to provide rigidity. Lower brace member 20 is connected by welding to base 14, as illustrated in FIG. 1, and includes movable connections to a brace member assembly 22 described below. In the embodiment illustrated, at least part of the top surface of base member 14 is textured with, for example, anti-skid strips 18.

In the embodiment shown, a lower brace member 20 is statically (as shown in FIG. 1) or movably (not shown) attached to an aft end of base member 14. Lower brace member 20 secures an upper U-shaped brace member 22, for example, using a hand operated fastener 24. Hand operated fastener 24 includes a set screw (as shown in FIG. 1) or a quick release sleeve and pin mechanism (not shown). Upper U-shaped brace member 22 mounts to and extends around the top of the aft section of pot 12, and is secured to lower brace member 20 on both sides of pot 12 (side view shown in FIG. 1, top view shown in FIG. 3). Braces 20 and 22 are slideable with respect to one another, which permits the height of upper U-shaped brace member 22 to be adjusted for securing apparatus 10 to commode 11. Brace member 22 includes through-holes 23 to be placed adjacent existing holes on commode 11 typically located for receiving bolts 30 from a conventional toilet seat, as shown in FIG. 3. A conventional toilet seat cover may be hingedly attached to base portion 40*a* of seat assembly 40 through holes 39.

In this embodiment, apparatus 10 is easily moved into position adjacent commode 11 by lifting hand holds 26 (shown in FIG. 3) provided at the forward end of base 14, and rolling apparatus 10 over commode 11 on wheels 28 (which may be retractable) mounted at the aft end of base 14 until through-holes 23 in upper U-shaped brace member 22 line up with the existing holes in commode 11 which are ordinarily used to secure a conventional toilet seat. Upper U-shaped brace member 22 will accommodate different heights of commodes 11 and heights of floor coverings by sliding upper U-shaped brace member 22 into lower brace member 20 and tightening hand operated fastener 24 after bolts 30 are secured in the existing holes 23 in the commode 11. It will be appreciated from the foregoing that brace assembly 20 and 22 is adjustable in height as well as longitudinally, and when fixed in position prevents side to side and front to rear sliding movement about commode 11.

Turning now to a consideration of the lift assembly and associated linkage of apparatus 10 according to the present invention, in the embodiment illustrated, a first vertically oriented and telescopically extendable support member 31 comprises a hydraulic cylinder 32 attached at its cap end to base 14 on each side of apparatus 10 using a base assembly weldment 34 and a fastener 36. A piston rod 38 of hydraulic cylinder 32 is pivotally attached to a seat assembly 40, at a forward point thereon, and an actuating (second) support member 42 by a fastener 44. An opposite end of actuating support member 42 includes a moveable connection such as a wheel 46, which is attached by a fastener 48 to support member 42. Wheel 46 is retained to base 14 by a retaining housing 50 attached, for example, by mechanical connection or a weld to base plate 14. Retaining housing 50 accommodates an end of actuating support member 42 and will be discussed in more detail below. An intermediate (third) support member 52 is pivotally attached to base assembly weldment 34 at one end, pivotally attached to actuating (second) support member 42 at a pivot axis 54, and pivotally attached to a seat (fourth) support member 56 at its opposite end. Intermediate (third) support member 52 translates movement between actuating (second) support member 42 and seat (fourth) support member 56. One end of seat support member 56 is pivotally attached to seat assembly 40 at a rearward point thereon.

As illustrated in FIG. 2, seat 40 is generally channel-shaped in cross section and is of one piece construction including a base portion 40*a* and side walls or arms 40*b*. Base portion 40*a* includes a suitable opening centrally therein, as illustrated in FIG. 3.

Attached to seat 40 is a control device 58 for controlling actuation of hydraulic cylinders 32 (on both sides of apparatus 10) to provide either raising or lowering of seat 40 relative to commode 11 as described in more detail below.

FIG. 2 illustrates a front view of the preferred embodiment of apparatus 10 showing seat 40 in the lowered positioned. In this embodiment, apparatus 10 is essentially symmetrical about a vertical axis 41 passing through toilet tank 13 and pot 12, and most of the control linkage mechanism is duplicated at horizontally spaced locations on each side of commode 11. More specifically in this regard, the only component that is not duplicated is activating/control device 58 and the three lines 72, 74, and 82 connected to device 58, described below.

Figure 5:
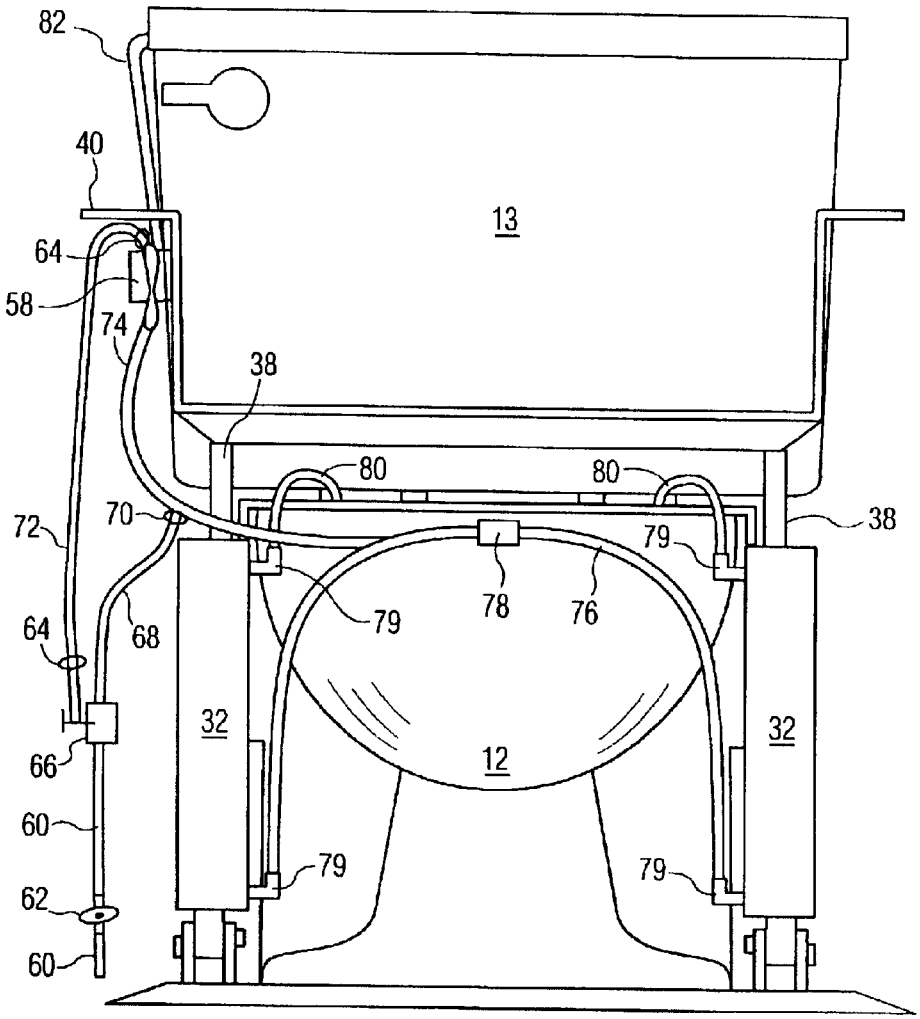
FIG. 5 is a front plan view of the apparatus illustrated in FIG. 1, including water connections.

FIG. 5 illustrates a front view of the preferred embodiment of the apparatus illustrated in FIG. 1, showing seat 40 in the lowered position, i.e., in the position shown in FIG. 2, and illustrates the hose connections required in order for hydraulic cylinder 32 to function properly. These hose connections typically comprise a cold water line 60, that first enters the bathroom via the floor or a wall. Existing shut-off valve 62 provides the ability to turn off the flow of water to tank 13. Valve 66 is provided as a means for delivering existing pressurized water to control device 58 via valve line 72, and may be installed with a screw driver. Existing water line 68 is secured to tank 13 via nut 70. An intermediate line 74 provides a connection between activating device 58 and a cylinder line 76. This intermediate line 74 is connected to the cylinder line 76 via a "T" fitting 78, and each end of the cylinder line 76 is connected to the cap end of each hydraulic cylinder 32 via a fitting 79. This cylinder line 76 supplies water to each hydraulic cylinder 32. A relief line 80 is connected to the head (rod) end of each hydraulic cylinder 32 via a fitting 79, and vents into the pot 12 providing air relief for each hydraulic cylinder 32. A discharge line 82 is connected to the control device 58, and drains into tank 13 providing water discharge for each hydraulic cylinder 32.

Considering the overall operation of apparatus 10 of the invention, a first mode of operation is commenced when a user is seated on seat 40 in its lowered position, and the user's feet are resting on textured surface 18 of base member 14. The user sets activating device 58 to a control position or setting to move seat 40 to the raised position shown in FIG. 1 from the lowered position shown in FIG. 2. In this seated position, activating device 58 causes water to flow from existing cold water line 60 to valve 66 into valve line 72. The water flows from valve line 72 to intermediate line 74 in this setting of activating device 58. The water flowing through intermediate line 74 is then diverted through "T" fitting 78 and into cylinder lines 76 on both sides of seat 40, increasing pressure in each hydraulic cylinder 32 to cause piston rod 38 to be pushed outwardly to an extended position. Air in the head (rod) end of each hydraulic cylinder 32 is vented through relief line 80 into pot 12. The outward movement of each piston rod 38 causes each actuating support member 42 to simultaneously move upwardly and to rotate about its pivot axis 54. The movement of actuating support member 42 causes intermediate support member 52 to simultaneously move upwardly and to rotate about its pivot axis 54. The movement of intermediate support member 52 causes seat support member 56 to simultaneously move upwardly, thereby causing seat 40 to simultaneously move to its raised position, as illustrated in FIG. 1, thereby raising seat 40 into an extended position.

Retaining housing 50, which is attached at base 14 and accommodates one end of actuating support member 42, limits the travel of actuating support member 42, to a horizontal plane. More specifically, when hydraulic piston rod 38 is housed inside cylinder 32 in its retracted position, lifting wheel 46 is positioned at the aft end of retaining housing 50, and seat 40 is in its lowered position, as shown in FIG. 2. When piston 38 is pushed outwardly to an extended position, the simultaneous upward movement of actuating support member 42 causes wheel 46 to travel forward. The extent of the forward position of lifting wheel 46 is limited by the stroke of hydraulic cylinder 32.

As the foregoing discussion described, the movement is translated through linkage assembly 42, 52, and 56, as seat 40 is urged to its raised position as shown in FIG. 1. As limited by the stroke of hydraulic cylinder 32 and the longitudinally fixed positions of the lower ends of actuating support member 42 and intermediate support member 52, seat 40 moves only vertically while pivoting at pivot point 44, so that the weight of the user is kept over the middle portion M of base 14, aft of vertical plane V, i.e., aft of the forward portion F of base 14 and forward of the rearward portion R of base 14. Retaining housing 50 retains lifting wheel 46 to prevent seat assembly 40 from exceeding vertical plane V, thereby limiting seat 40 to a position behind a significant portion of base 14, where the user's feet are placed and where as the user stands, the user's weight is fully supported. This also stabilizes apparatus 10, by preventing forward tipping or moving of apparatus 10.

By setting control device 58 to a position allowing pressure to be reduced in each hydraulic cylinder 32, the weight of a user sitting on seat 40 (or the weight of the seat itself) forces each piston rod 38 back into hydraulic cylinders 32 to its retracted position. The water in each hydraulic cylinder 32 flows into cylinder line 76, and is diverted through "T" fitting 78 and into intermediate line 74. The positioning of the control device 58 allows the water to then flow through discharge line 82 which, in one embodiment, empties into tank 13. The reduction in water pressure causes seat 40 to gradually move to the lowered position, thereby assisting the user down on seat 40.

In another embodiment, apparatus 10 can be moved, for example, by an electric motor/worm gear combination, actuating a vertically extendable first support member corresponding to member 31 in FIG. 1.

Apparatus 10 of the present invention can be installed on any commode 11 that would fall in the category of standard (e.g. oval, elongated, or commercial), and is constructed to accommodate the differing heights and lengths of various commodes with the simple adjustment discussed above, i.e., the adjustments permitted by brace members 20 and 22 and hand operated fastener 24, illustrated in FIG. 1.

In the embodiment illustrated, apparatus 10 of the present invention can be used at any location where a water source is available or can be made available, and in this regard, the water source can be a simple garden hose.

An apparatus as described herein, with a sling seat substituted for "seat" 40, may be utilized to raise or lower a user into or out of any conventional chair that will accommodate the lifting apparatus described herein.

Although the present invention has been described relative to specific exemplary embodiments thereof, it will be understood by those skilled in the art that various other forms of the invention may be devised without departing from the scope and spirit of the invention. The claims which follow should be construed to include all such forms and embodiments.

What is claimed is:

1. An apparatus to automatically raise and lower a seat, said apparatus comprising:

a base having a rearward portion and a forward portion, and a middle portion between said rearward and forward portions;

a channel attached to said base in said middle portion, said channel accommodating an extendable and retractable member; and a seat attached to said member and slideably attached to said rearward portion of said base, wherein said seat has a range of motion and said range of motion is restricted to said middle portion.

2. The apparatus recited in claim 1, further comprising an actuating support member pivotally attached to said member, and slideably attached to said rearward portion of said base.

3. The apparatus recited in claim 2, further comprising an intermediate support member pivotally attached to said middle portion of said base, and pivotally attached to said actuating support member.

4. The apparatus recited in claim 3, further comprising a seat support member pivotally attached to said seat, and pivotally attached to said intermediate support member.

5. The apparatus recited in claim 2, wherein said rearward portion of said base includes a retaining housing attached to said base and accommodating one end of said actuating support.

6. The apparatus recited in claim 1, wherein said member moves in said channel by hydraulic pressure.

7. The apparatus recited in claim 6, further comprising a control valve attached to said channel for regulating pressure in said channel.

8. The apparatus recited in claim 1, wherein said seat does not extend beyond a forward position of said channel throughout said range of motion.

9. An apparatus for raising and lowering a planar member having a front and a back to and from a first lowered position to a second raised position, said planar member having a front point which remains, throughout the raising and lowering of said planar member, in a vertical plane, perpendicular to a line extending from the front to the back of the planar member, and also having a rear point which, during the raising and lowering movement, moves upwardly and forwardly while pivoting about the front point, said apparatus further including a base member, a vertically extendable first support member fixed at its upper and lower ends to the front point of said planar member and to said base member, respectively, a second support member, one end of which is pivotally connected to one or both of said first support member at its upper end and the front point of said planar member and another end of which is movably retained on said base member rearward of the vertical plane in which the front point of said planar member moves and is movable along a line perpendicular to that vertical plane, and a third support member pivotally connected at one end to the base member near the lower end of the first support member, and at its another end to an end of a fourth support member, and at a point between its ends to said second support member at a point between the ends thereof, wherein said fourth support member is pivotally connected at another end to said planar member at a rearward point thereof, said third and fourth support members forming an angle between them, said third support member extending upwardly and rearwardly form the point where it is connected to said base member, and said fourth support member extending upwardly and forwardly from the point where it is connected to said third support member.

10. The apparatus recited in claim 9, wherein said planar member is a seat and said four support members and their respective pivotal connections are duplicated at horizontally spaced locations on either side of the planar member and fixed to a common base member.

11. The apparatus recited in claim 10, wherein the base member extends sufficiently forwardly from the vertical plane in which the front points of the seat moves so that the feet of a person seated on the seat can rest on the forward portion of the base member as the seat is raised and lowered.

12. The apparatus recited in claim 11, wherein the base member includes wheels on the rear thereof, the diameter and positioning of the wheels on the base member being selected so that when the front of the base member is lifted, the weight of the base member is supported on the wheels.

* * * * *